US009876326B1

(12) United States Patent
Pagé

(10) Patent No.: US 9,876,326 B1
(45) Date of Patent: Jan. 23, 2018

(54) UNIVERSAL LIGHTBULB SOCKET

(71) Applicant: Philippe A. Pagé, Ontario (CA)

(72) Inventor: Philippe A. Pagé, Ontario (CA)

( * ) Notice: Subject to any disclaimer, the term of this patent is extended or adjusted under 35 U.S.C. 154(b) by 0 days.

(21) Appl. No.: 15/419,548

(22) Filed: Jan. 30, 2017

(51) Int. Cl.

| | |
|---|---|
| ***H01R 13/22*** | (2006.01) |
| ***H01R 33/22*** | (2006.01) |
| ***F21V 23/06*** | (2006.01) |
| ***H01R 13/24*** | (2006.01) |
| *H01R 103/00* | (2006.01) |

(52) U.S. Cl.
CPC ..... *H01R 33/22* (2013.01); *F21V 23/06* (2013.01); *H01R 13/2407* (2013.01); *H01R 2103/00* (2013.01)

(58) Field of Classification Search
CPC ..... H01R 33/22
USPC ..... 439/753, 253–257, 665, 356
See application file for complete search history.

(56) References Cited

U.S. PATENT DOCUMENTS 438,310 A 10/1890 Edison
1,327,496 A * 1/1920 Snider ..... H01R 33/9555 16/109
1,640,189 A * 8/1927 Hamiel ..... H01R 33/22 439/257
1,663,264 A * 3/1928 Thompson ..... H01R 33/971 439/735
1,700,495 A * 1/1929 Hayward ..... H01R 13/20 439/256
1,702,135 A * 2/1929 Sawers ..... H01J 5/50 439/645
1,721,365 A * 7/1929 Zwetsch ..... H01R 33/22 439/253
1,728,485 A * 9/1929 Freeman ..... H01R 33/22 411/262
1,907,422 A * 5/1933 Long ..... H01R 33/06 439/257
1,928,657 A * 10/1933 Wolfe ..... H01R 33/9555 439/257
2,071,769 A * 2/1937 Schlicker ..... H01R 33/22 439/257
2,154,812 A * 4/1939 Adalbert ..... B65D 41/0471 220/288
2,191,336 A * 2/1940 Carroll ..... H01R 33/22 362/390
2,253,582 A * 8/1941 Richardson ..... H01R 33/94 439/256
2,549,577 A * 4/1951 Coyle ..... H01R 13/111 439/843
2,640,969 A * 6/1953 Coyle ..... H01R 33/22 439/661
2,648,049 A * 8/1953 Brayman ..... H01R 33/9555 200/51.14

(Continued)

*Primary Examiner* — Ross Gushi
(74) *Attorney, Agent, or Firm* — Blank Rome LLP

(57) ABSTRACT

A socket having a quick release to removably and reliably receive a light bulb. A flat circular base has a top surface and an outer periphery. A plurality of flexible elongated plastic prongs extend outward from the top surface about the outer periphery of the base. The prongs are threaded and can flex outward to permit the light bulb to be pulled straight out of or pushed straight into the socket without turning the light bulb. A first elongated metal socket contact is positioned along at least one of the flexible elongated plastic prongs. A second metal socket contact is positioned at the top surface of the base.

14 Claims, 6 Drawing Sheets

(56) References Cited

U.S. PATENT DOCUMENTS 2,869,097 A * 1/1959 Simon ..... H01R 33/22 439/256
3,165,370 A * 1/1965 Laub, Sr. ..... H01R 33/22 439/257
3,251,023 A * 5/1966 Schick ..... F21V 21/002 439/414
3,504,329 A * 3/1970 Peterson ..... H01R 33/22 439/257
3,676,835 A * 7/1972 Holly ..... H01K 1/46 439/256
3,895,195 A * 7/1975 Morrison ..... H01R 33/962 200/51.09
4,768,966 A * 9/1988 Doherty ..... H01R 13/44 439/137
4,875,866 A 10/1989 Winant
4,886,994 A * 12/1989 Ragge, Jr. ..... F21V 19/006 313/316
4,915,667 A * 4/1990 Tobias-Pader ..... H01H 85/2005 439/257
5,154,628 A * 10/1992 Skegin ..... H01R 33/46 439/336
5,171,292 A * 12/1992 Ortiz ..... H01R 33/20 439/253
5,380,214 A * 1/1995 Ortega, Jr. ..... H01R 33/22 439/253
5,382,181 A * 1/1995 Ortiz ..... H01R 33/20 439/628
5,586,904 A * 12/1996 Huang ..... H01R 33/22 439/395
5,641,303 A * 6/1997 Chiu ..... H01R 4/2404 439/419
5,702,267 A * 12/1997 Chen ..... F21V 21/002 439/340
5,769,655 A * 6/1998 Tsai ..... H01R 4/2404 439/419
5,807,134 A * 9/1998 Hara ..... H01R 4/2404 439/340
5,823,829 A * 10/1998 Suzuki ..... H01R 33/05 439/665
5,848,909 A * 12/1998 Tsai ..... H01R 4/2404 439/206
5,897,391 A * 4/1999 Takahashi ..... H01R 13/641 439/336
6,267,612 B1 * 7/2001 Arcykiewicz ..... H01R 13/6275 439/253
6,406,333 B2 * 6/2002 Harris ..... H01R 33/22 313/318.09
6,652,305 B1 * 11/2003 DiFusco ..... H01R 31/06 439/255
7,413,456 B1 * 8/2008 DiFusco ..... H01R 33/22 439/253
7,585,187 B2 * 9/2009 Daily ..... F21V 19/0025 362/640
7,618,288 B1 * 11/2009 DiFusco ..... H01R 33/22 439/253
7,850,472 B2 * 12/2010 Friedrich ..... H01R 13/506 439/256
7,905,738 B2 * 3/2011 Donetsky ..... H01R 4/48 439/254
8,502,468 B2 * 8/2013 Li ..... F21V 23/06 313/318.01
8,602,802 B2 * 12/2013 Sanchez ..... H01R 33/94 439/257
8,668,504 B2 * 3/2014 Cofini ..... H01R 33/22 439/101
9,214,776 B2 * 12/2015 Cofini ..... H01R 33/22
9,478,929 B2 * 10/2016 Smith ..... H01R 33/22
9,608,394 B2 * 3/2017 Fruhauff ..... H01R 33/22

* cited by examiner

UNIVERSAL LIGHTBULB SOCKET

BACKGROUND OF THE INVENTION

Field of the Invention

The present invention relates to a socket for a lightbulb.

Background of the Related Art

Threaded light bulb sockets are well known due to their ubiquity, though there are many different designs in the prior art which have been developed to supply power to, and hold, a light bulb in place.

The most common light bulb used in home lighting is the Edison Screw base, which is described in U.S. Pat. No. 438,310, to T. A. Edison in 1890. The light bulb 30 is shown in FIG. 1. The bulb 30 has a body or housing 32, and a pressed metal externally threaded sleeve 28 that extends about the sides of the bulb housing 32 at the distal end of the bulb 30. The threaded sleeve 28 forms a first contact of a circuit, and a separate second contact 24 is located in the center of the very distal end of the bulb 30. The first and second contacts 28, 24 connect to circuit elements (such as a wire) that are contained inside the light bulb housing 32. That general design is now standard in the industry, which allows bulbs from different companies to be replaced in the same permanent fixture. That configuration is generally referred to here as the standard light bulb.

Light bulbs are used in a wide variety of light bulb fixtures, such as lamps, track lighting, recessed lighting, and the like. Those fixtures have an internally threaded light socket that receives the light bulb. The socket has a first and second contact that mate with the respective first and second contacts of the light bulb only when the light bulb is fully received in the socket. That allows electricity to be delivered to the internal elements of the light bulb to complete a circuit.

By design, the standard light bulb must be rotated or turned to install and/or remove the light bulb from the light fixture socket by threadably engaging the external threads of the light bulb with the internal threads of the socket. That allows the light bulb to be removed and a new one installed, to change the bulb once it burns out, breaks or as otherwise desired. That action is commonly referred to a screwing in or unscrewing the light bulb to/from the socket.

However, screwing in and unscrewing a light bulb can be time consuming, especially when many light bulbs need to be changed. It also requires a good deal of fine dexterity and twisting of the wrist, which can be difficult for older persons and persons with disabilities such as arthritis.

Several designs have been made to engage a light bulb with a light socket, such as shown in U.S. Pat. Nos. 4,915,667, 4,875,866, and 5,380,214. However, a design is needed to quickly and reliably engage a standard light bulb with a light socket.

SUMMARY OF THE INVENTION

Accordingly, it is an object of the invention to provide a light bulb socket. It is a further object of the invention to provide a light bulb socket that is easy to insert and remove a light bulb, and especially a standard light bulb having a threaded end. It is a further object to provide a light fixture having a light bulb socket that is easy to use.

In accordance with these and other objects of the invention, a light bulb socket is provided that is easy to use. The socket has independent prong elements that can bend outward to permit push/pull replacement of the light bulb, while at the same time the prong elements reliably retain the light bulb after installation of the light bulb. The prong elements utilize tension and flexion to reliably retain the light bulb, but also permit easy removal and insertion of replacement light bulbs.

The socket receives a standard light bulb having a threaded end. The light bulb can be quickly and easily inserted into the socket and quickly and easily removed from the socket. During use, the socket reliably retains the light bulb until it is ready to be replaced. The invention provides an improved alternative to the common Edison Screw type light bulb socket. The invention is a redesigned light bulb socket that allows replacement of standard threaded light bulbs with a linear push-pull motion rather than a rotational one.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
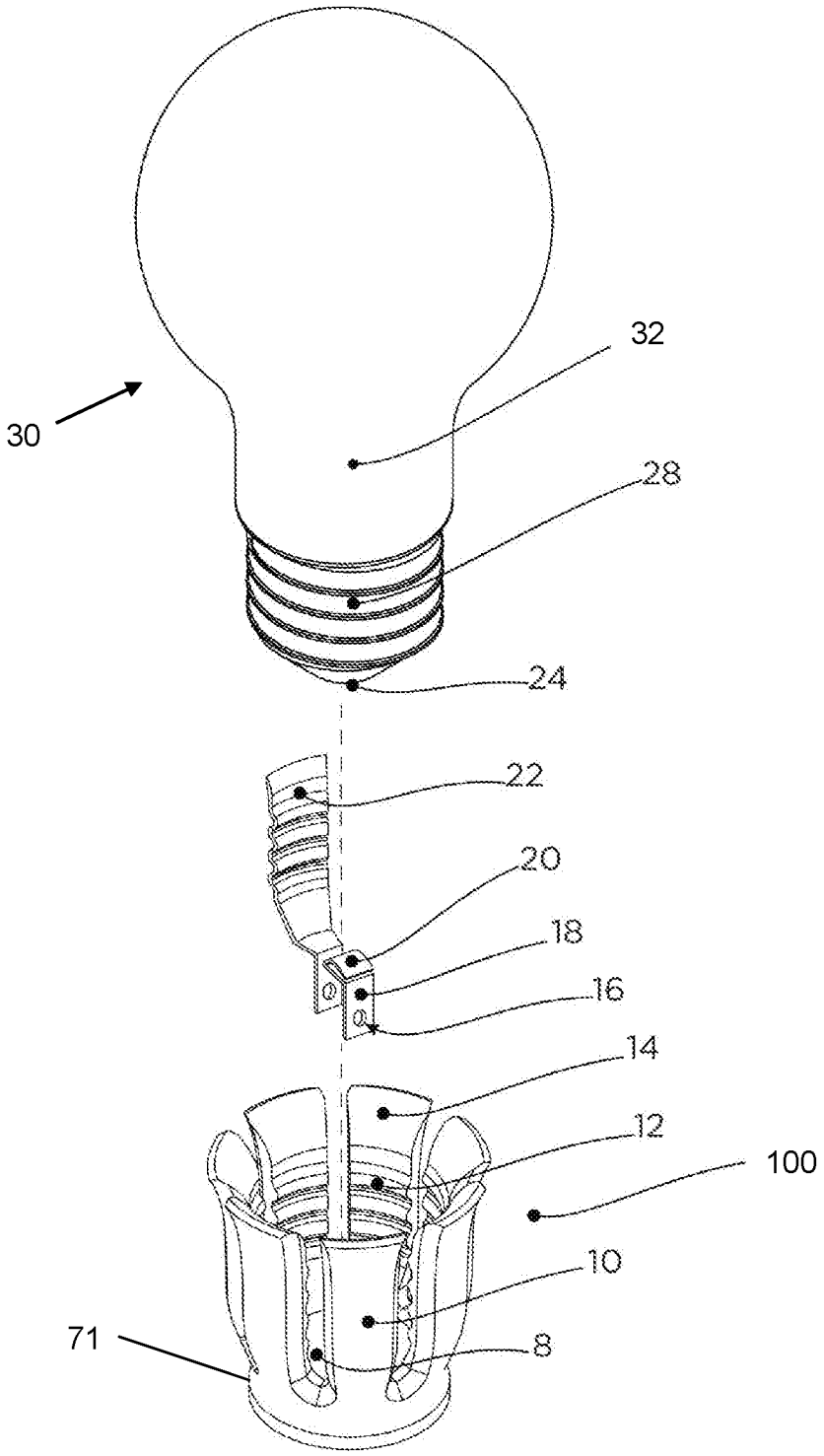
FIG. 1 shows a perspective exploded view of the socket of the present invention with a standard Edison-Screw type light bulb.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Referring now to the drawings, FIGS. 1-6 show a light bulb socket 100 in accordance with an embodiment of the invention. The socket 100 has a body 71 with a base 8 and elongated finger members or prongs 10. The base 8 is a flat circular plate having a top surface, and a bottom surface. In the embodiments shown, the base 8 is arranged substantially horizontally. The prongs 10 extend substantially orthogonally outward (substantially vertically upward in the embodiment shown in FIG. 1) from about the outer periphery of the upper surface of the base 8.

As further shown, the prongs 10 have a proximal end 14 that are integrally formed with the base 8, a distal end that extends outward from the base 8, and an intermediate portion between the distal end and the proximal end. The prongs 10 are arranged about the base 8 to substantially form a circular enclosure having a central opening. The prongs 10 have elongated slots between them and the neighboring prongs are not coupled with each other. Accordingly, the prongs 10 can flex inward and outward independently slightly. The distal ends 14 of the prongs 10 can have a beveled edge that provides a wider central opening at the very distal ends of the prongs 10.

The intermediate portions of the prongs 10 have an internal surface that is threaded to form a threaded section of each prong 10. The threaded sections of the prongs 10 collectively form a threaded portion that match and can mate with the threaded sleeve 28 of the bulb 30. The beveled edges are smooth (not threaded), so that the beveled distal end portion of the prongs 10 guide the bulb 30 toward the internal threaded portion of the prongs 10.

The body 71 of the socket 100 is an injection molded, high temperature plastic. The entire body 71 is formed as a single unitary piece, including the prongs 10 with threaded sections and the base 8. The body 71 can be produced by a multiple part mold with a collapsible core to allow the undercuts of the threading to be produced and the core of the mold to be removed. The plastic is an insulator, so it does not conduct electricity. Accordingly, a first metal electrical contact 20 and a second metal contact 22 are provided to electrically couple with the first and second contacts 28, 24 of the bulb 30, respectively. The first or bottom metal contact 20 can be, for example, an elongated flat metal tab or piece having a first contact portion at a first proximal end and a second contact portion at a second distal end. The proximal end of the bottom contact 20 can be provided on the top surface of the base 8 at the interior space of the socket 100 to mechanically and electrically engage the second contact 24 of the bulb 30 when the bulb 30 is fully received by the socket 100. The distal end 16 of the bottom contact 20 can extend to the outside of the socket 100 or outside the base 8, and can connect with an electrical wire or the like. In an alternative embodiment, the electrical wire can connect directly to the proximal end of the bottom contact 20 and a distal end need not be provided.

The second or side contact 22 can be an elongated thin metal piece that has a shape which matches the contour of the inner surface of at least one prong 10. Thus, the side contact 22 has a proximal end, distal end and intermediate portion therebetween. The intermediate portion has a threaded section. The distal end and intermediate portion can be located at the interior of the socket 100, and the proximal end can extend to the exterior of the socket 100 or base 8. A wire can connect with the proximal end at the exterior of the socket 100 or base 8. The side contact 22 mechanically and electrically couples with the sleeve contact 28 of the bulb 30. The side contact 22 is sufficiently thin to be flexible so that it can bend inward and outward with the prong to which it is fixed.

Thus, the bottom contact member 20 and the side contact member 22 are each positioned in the interior space of the socket 100 to be in direct contact with the respective contacts 24, 28 of the bulb 30. The bottom contact 20 connects with the distal end contact 24 of the bulb 30, and the side contact 22 connects with the sleeve contact 28 of the bulb 30. And, bottom and side contacts 20, 22 connect with wires to a power supply (such as via a switch or other electrical component). Thus, the contacts 20, 22 provide power/electricity from the power supply to operate the light bulb 30 via contacts 24, 28, respectively. The contacts 20, 22 can be separate metal elements that are coupled to the base 8 and prong 10, respectively, such as by a glue or fastener. Or, the contacts 20, 22 can be formed integral to the base 8 and/or prong 10, or can be a metallic coating that is applied to the base 8 and/or prong 10. The side contact 22 can also be a metal wire that is embedded in the side prong 10. The bottom contact 18 can be made for instance, by bending a strip of sheet metal of similar thickness and material as the side contact 22, and conducts electricity from the eyelet of the light bulb 30 to the other end of the socket circuit, i.e., the bottom contact 18. Both the side contact 22 and the bottom contact 18 are inserted through the base 8, and extend through to the other side to allow the fixture to be wired into electricity cords, lamps, other format threading, or wall/ceilings. The plastic body can be injection molded around the metal contacts or the contacts can be added by inserting through the base 8. Still further, one or more of the prongs 10 can be metal or a distal portion of one or more of the prongs 10 can be metal and the proximal end plastic.

The plastic material of the body 71 allows the prongs 10 to independently flex inward and outward slightly with respect to the base 8 and the central opening. The prongs 10 have at least three positions: an innermost position, an operating position, and an outward receiving position. The prongs 10 are biased inward to the innermost position. The prongs 10 default to the innermost position when no bulb 30 is received by the socket 100.

The operating position is slightly outward of the innermost position. The prongs 10 are in the operating position when a bulb 30 is received in the central opening of the socket 100. In the operating position, the threaded portions of the prongs 10 reliably and mechanically engage the threaded sleeve 28 of the bulb 30. In the operating position, the prongs 10 exert a sufficient inward force on the sleeve 28 of the bulb 30 to mechanically couple the bulb 30 with the socket 100. The bulb 30 does not inadvertently separate from the socket 100, even if the bulb 30 is suspended upside-down in the socket 100 such as if the socket 100 is mounted in a ceiling mounted fixture.

In addition, in the operating position, the contacts 28, 24 of the bulb 30 reliably and electrically couple with the contacts 22, 20 of the socket 100. The side contact 22 electrically couples with the sleeve contact 28, and the distal end contact 24 electrically couples with the bottom contact 18.

In the outward receiving position, the prongs 10 move outward by force of the outmost portions of the threads of the sleeve 28 pushing against the outermost portions of the threads of the prong inner surface 12. This happens as the user pushes the bulb 30 into the socket 100 or pulls the bulb 30 out of the socket 100. Flexion of the prong elements 10 allow the bulb threading to skip past the socket fixture threads 12, which in turn allows the bulb 30 to be fully inserted and withdrawn without a screwing motion. Instead, the user only needs to push the bulb straight into the socket until the bulb is fully seated in the socket and the distal contact 24 connects to the bottom contact 18. And the user need not perform a screwing motion to retract the bulb from the socket, but only needs to pull the bulb straight out of the socket, thereby providing a quick insert and release for installation and replacement of the light bulb to the socket. Though it doesn't require it, this design still permits installation by a screwing motion. For example, the user can push the bulb into the socket then screw the bulb further into the socket to connect the distal contact 24 to the bottom contact 18. Once the bulb is installed, the prongs 10 clasp around the light bulb's thread-base 28 when fully engaged, holding it in place.

The diameter of the central opening defined by the prongs 10 depends on the diameter of the bulb type to be supported by said fixture, most commonly the E27 screw. The invention may also differ in size and diameter to fit different light bulb screw type sizes, including but not limited to E-5, E-10, E-12, E-14, E-17, E-26, E-40. Or an adapter 2 (FIG. 5) may convert between two different size formats.

Figure 2:
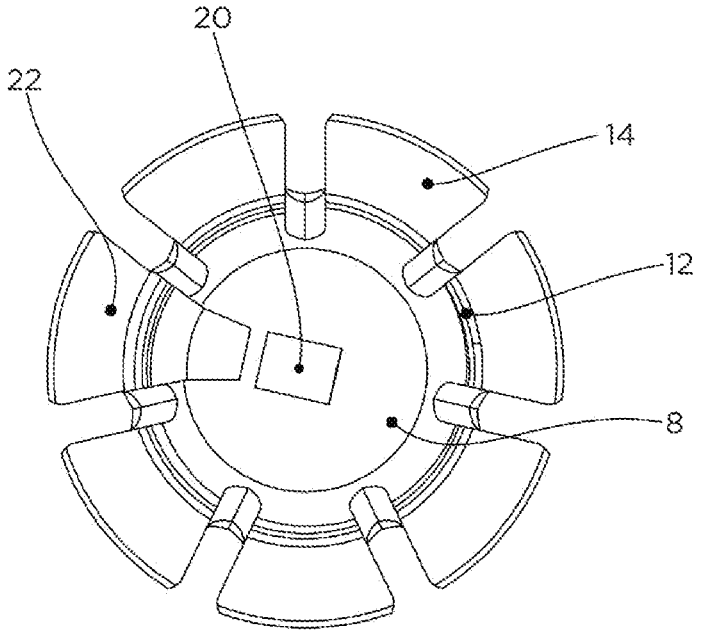
FIG. 2 is a top view of the socket.
Figure 3:
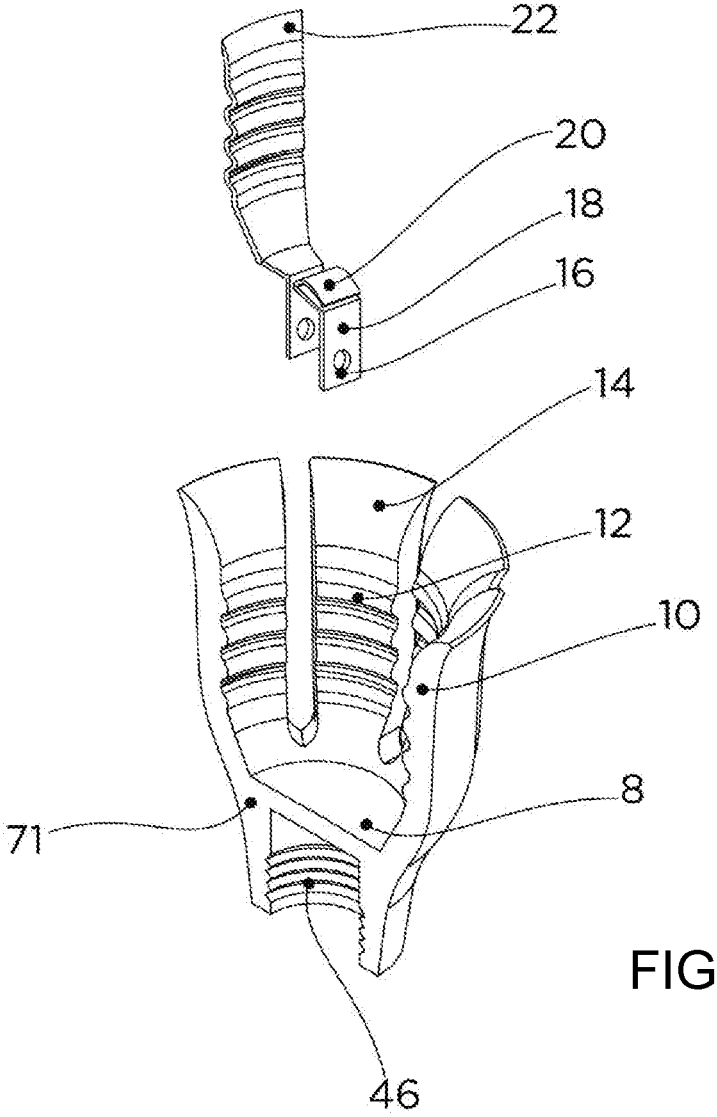
FIG. 3 is a cut cross-section exploded-view of the socket intended for use in lamps, showing both side and bottom contacts, and with a threaded base terminal for use within light fixtures.
Figure 4:
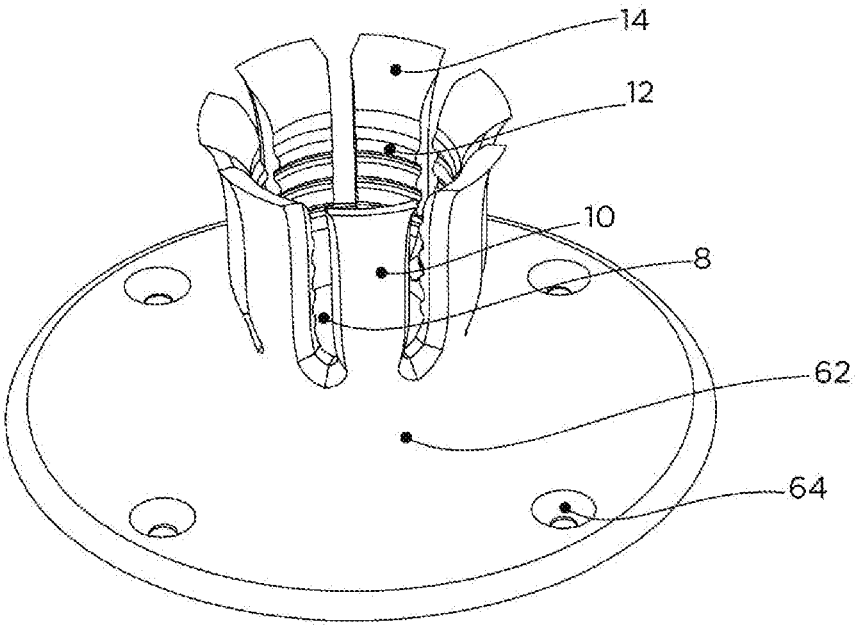
FIG. 4 is a perspective view of one embodiment of the present invention incorporated into a light fixture for ceiling or wall applications.

FIGS. 1-2 illustrate one embodiment of the invention, where the socket 100 can be used in any conventional light fixture, such as a lamp or the like. FIG. 3 illustrates another example embodiment of the invention, where a female connector 46 is positioned at the bottom of the base 8. The female connector 46 can be utilized to connect to certain standard light fixtures, such as a lamp or the like. FIG. 4 illustrates yet another example embodiment of the invention where the socket 100 is configured for use with a face plate 62, which can be suitable for example for mounting on a wall or ceiling. Here, the base 8 and prongs 10 can be integrally formed with the face plate 62. Yet another embodiment of the invention is shown for example in FIG. 6, where the socket 100 is integrally formed with a cord or a corded fixture 70. Here, the cord can connect for example with the base 8 or contacts.

Figure 5A:
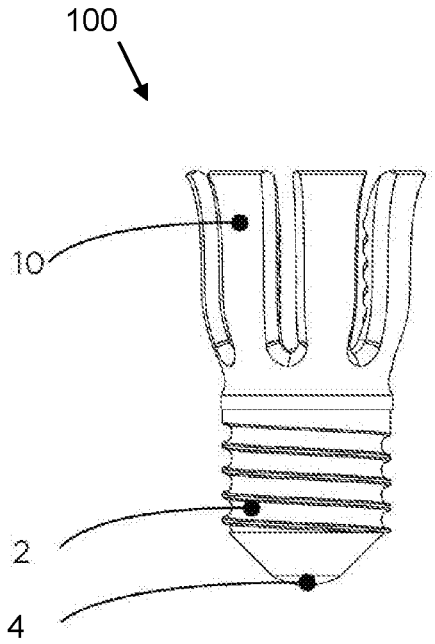
FIGS. 5(*a*) and 5(*b*) is a side and perspective view of an embodiment of the invention configured for use as an adapter to convert an existing standard light socket to the socket of the present invention.
Figure 5B:
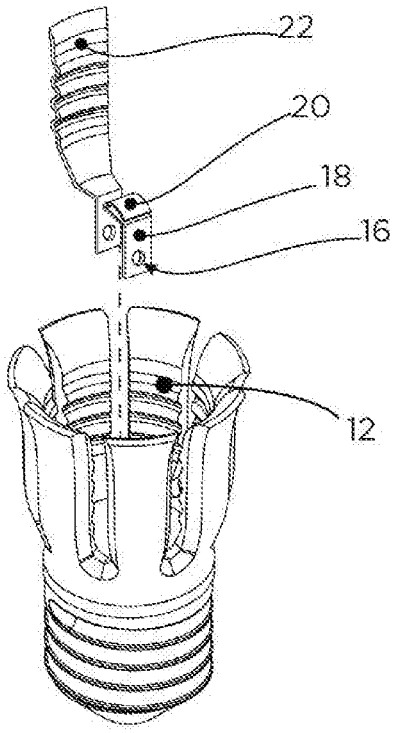
Figure 6:
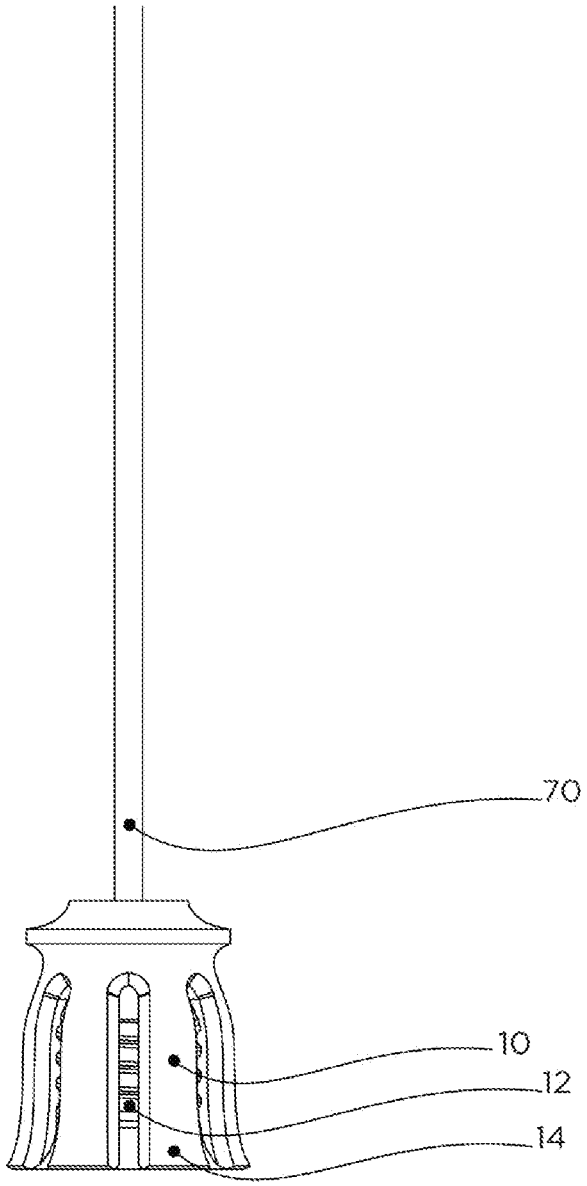
FIG. 6 is a view of an embodiment of the present invention incorporated into a corded light socket.

Another embodiment of the invention is shown in FIG. 5. Here, the socket 100 is embodied in an adapter 2. The socket 100 includes flexible prong members 10 and a base 8, as well as side and bottom sockets 22, 20. A male connector 4 is formed at the bottom of the base 8. The male connector 4 projects outward (and downward in the embodiment of FIG. 5) from the bottom of the base 8. An external sleeve can extend around the outside of the male connector 4 and connect with the side contact 22. A distal contact point can be formed at the bottom distal end of the male connector 4 and be electrically connected with the bottom contact 20. Accordingly, the distal contact of the male connector 4 is electrically coupled with the distal contact 24 of the bulb via the bottom contact 20. And the side contact of the male connector 4 is electrically coupled with the sleeve contact 28 of the bulb via the side contact 22. The male connector 4 can be fitted to a socket having a different or same size as the socket 100. Accordingly, the adapter 2 can convert an original socket to accept a same size bulb or a different size bulb, either larger or smaller in size than the original socket, in the quick-connect socket 100.

The body 71 is constructed of but not limited to high temperature plastics. The body 71 and prongs 10 can be produced through injection molding, incorporating the use of a collapsible core mold, or can be milling or 3D printing.

It is further noted that the invention is shown and described where the socket 100 is free-standing; that is, it is not incorporated in a housing. Thus, the prongs 10 are able to flex outward without coming into contact with the housing or another member. It should be noted that the socket 100 can be incorporated in a housing or any light fixture or accessory. However, sufficient space should be provided around the outer periphery of the prongs 10 so that the prongs are free to flex outward, and particularly at the distal ends since they move further outward.

It is further noted that the description uses several geometric or relational terms, such as circular, rounded, beveled, perpendicular, and flat. In addition, the description uses several directional or positioning terms and the like, such as top, bottom, left, right, up, upward, downward, interior, exterior, distal, and proximal. Those terms are merely for convenience to facilitate the description based on the embodiments shown in the figures. Those terms are not intended to limit the invention. Thus, it should be recognized that the invention can be described in other ways without those geometric, relational, directional or positioning terms. In addition, the geometric or relational terms may not be exact. For instance, walls may not be exactly perpendicular or parallel to one another but still be considered to be substantially perpendicular or parallel because of, for example, roughness of surfaces, tolerances allowed in manufacturing, etc. And, other suitable geometries and relationships can be provided without departing from the spirit and scope of the invention.

It is noted that the contacts 22, 20 are described as being connected to the prong 10 and/or base 8 by epoxy or adhesive. Those connections are intended to fixedly attach those elements to one another to form a rigid, reliable, and permanent attachment. One skilled in the art will recognize that other suitable fixed attachments may be appropriate other than epoxy or adhesive, such as fasteners, or integrally forming the elements as one piece. Thus, the specific connections are not intended to be limiting on the invention.

Accordingly, the invention is universal, in that it can be utilized with any light housing or accessory. In addition, the invention can be utilized with light bulbs of different sizes and shapes, though preferably threaded or having an engagement mechanism and two electrical contact points. The invention can be configured in different sizes and shapes to accommodate different light bulbs and/or housings or accessories. In addition, the invention is universal in that it can be flexibly provided in objects and environments, and is readily accessible to elderly or people with physical disabilities.

Within this specification, the terms "substantially" and "about" mean plus or minus 20%, more preferably plus or minus 10%, even more preferably plus or minus 5%, most preferably plus or minus 2%. In addition, while specific dimensions, sizes and shapes may be provided in certain embodiments of the invention, those are simply to illustrate the scope of the invention and are not limiting. Thus, other dimensions, sizes and/or shapes can be utilized without departing from the spirit and scope of the invention.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A socket for use with a light bulb having a sleeve forming a first bulb contact with a threaded portion, and a distal end having a second bulb contact, said socket comprising:

a flat circular base having a top surface and an outer periphery;

a plurality of flexible elongated plastic prongs, each extending outward from the top surface about the outer periphery of said base and having a proximal end, distal end, and intermediate portion between the proximal end and the distal end, the intermediate portion having an inner surface with a threaded section, said plurality of prongs defining a central socket opening that removably receives the light bulb;

a first elongated metal socket contact positioned along at least one of said plurality of flexible elongated plastic prongs; and a second metal socket contact positioned at the top surface of said base;

wherein said plurality of prongs have a first operating position defining a first diameter whereby the threaded sections of said plurality of prongs engage the threaded portion of the light bulb and secure the light bulb to the socket in the central socket opening, and a second outward position defining a second diameter larger than the first diameter whereby the light bulb can be removed from and/or inserted into the central socket opening.

2. The socket of claim 1, wherein said plurality of prongs further have a third inward position defining a third diameter smaller than the first diameter, whereby said plurality of prongs are biased to the third inward position.

3. The socket of claim 1, wherein said plurality of prongs are biased inwardly to exert an inward force against the threaded portion of the light bulb in the first operating position and in the second operating position.

4. The socket of claim 1, wherein the light bulb can be pulled straight out of the socket to remove the light bulb from the socket without turning the light bulb or socket.

5. The socket of claim 1, wherein the light bulb can be pushed straight into the socket to insert the light bulb into the socket without turning the light bulb or socket.

6. The socket of claim 1, wherein the first socket contact follows a contour of the at least one prong.

7. The socket of claim 1, wherein the first socket contact is affixed to the at least one prong.

8. The socket of claim 1, wherein the first socket contact and the second socket contact extend through said base.

9. The socket of claim 1, wherein said plurality of prongs are sufficiently flexible to move between the first position and the second position, but exert a sufficient inward force to prevent the light bulb from inadvertently being released from said plurality of prongs in the first operating position.

10. The socket of claim 1, wherein in the first position said first socket contact electrically engages the first bulb contact and said second socket contact electrically engages the second bulb contact.

11. A socket for use with a light bulb, said socket comprising:

a flat base having a top surface;

a plurality of flexible elongated non-conductive arms extending outward from the top surface of said base to define a central opening that removably receives the light bulb, said plurality of arms inwardly biased to exert an inward force against the light bulb to retain the light bulb in the central opening, said plurality of arms being sufficiently flexible to flex outward to permit the light bulb to be inserted straight into and retracted straight from the central opening without turning the light bulb or socket;

a first discrete metal socket contact positioned along at least one of said plurality of arms to electrically engage the light bulb at a first light bulb contact; and a second discrete metal socket contact positioned at the top surface of said base to electrically engage the light bulb at a second light bulb contact.

12. The socket of claim 11, wherein the plurality of elongated arms are plastic.

13. The socket of claim 11, wherein the first discrete metal contact is positioned along an inside surface of said at least one of said plurality of arms.

14. The socket of claim 11, wherein no more than one first discrete metal socket contacts is positioned along said plurality of arms.

* * * * *